US006464547B2

(12) United States Patent
Ketelsleger

(10) Patent No.: US 6,464,547 B2
(45) Date of Patent: Oct. 15, 2002

(54) ELECTRICAL PIN CONTACT AND HOUSING

(75) Inventor: Kimberly A. Ketelsleger, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/784,420

(22) Filed: Feb. 15, 2001

(65) Prior Publication Data

US 2001/0034167 A1 Oct. 25, 2001

Related U.S. Application Data

(60) Provisional application No. 60/183,460, filed on Feb. 18, 2000.

(51) Int. Cl.[7] ..... H01R 11/22; H01R 13/11

(52) U.S. Cl. ..... 439/851; 439/748; 439/752.5; 439/857

(58) Field of Search ..... 439/745, 748, 439/752.5, 851–856, 857

(56) References Cited

U.S. PATENT DOCUMENTS

| | | | | | |
|---|---|---|---|---|---|
| 2,938,190 | A | | 5/1960 | Krehibiel | |
| 3,346,834 | A | | 10/1967 | Kinkaid | |
| 3,363,224 | A | | 1/1968 | Gluntz | |
| 3,634,811 | A | | 1/1972 | Teagno et al. | |
| 4,371,227 | A | | 2/1983 | Yosimura | |
| 5,256,088 | A | * | 10/1993 | Lu et al. | 439/851 |
| 5,266,056 | A | | 11/1993 | Baderschneider | 439/745 |
| 5,334,058 | A | | 8/1994 | Hotea | 439/839 |
| 5,411,412 | A | | 5/1995 | Ogawa et al. | 439/336 |
| 5,489,223 | A | | 2/1996 | Faje et al. | 439/748 |
| 5,860,838 | A | * | 1/1999 | Kaneko | 439/857 |
| RE37,296 | E | * | 7/2001 | Peterson | 439/677 |

* cited by examiner

*Primary Examiner*—Khiem Nguyen

(57) ABSTRACT

An electrical connector has a contact having redundant contact points for interconnection to an electrical pin terminal. The contact portion is defined by a base section of the terminal having upstanding wall sections defined by upstanding strap portions and an intermediate beam section. The intermediate beam section has a first constricted portion defining parallel and opposed constricted walls, where each constricted portion includes inwardly directed C-shaped projections defining internal contact surfaces for contact with a pin. The contact has an upstanding polarizing feature which is wider than the upstanding wall sections of the contact member. The corresponding housing includes a projection on the internal surface of the cavities which allows the polarizing feature of the contact to pass beneath, but which cannot allow improper loading of the terminals within the respective terminal receiving cavities.

17 Claims, 7 Drawing Sheets

ELECTRICAL PIN CONTACT AND HOUSING

BACKGROUND OF THE INVENTION

Field of the Invention

The invention relates to an improved electrical contact for mating with a pin terminal.

SUMMARY OF THE PRIOR ART

The design of an electrical contact is tremendously difficult due to the number of factors which must be considered. Firstly, whether for mating with a pin or tab-type male counterpart, the contact portion of the terminal must provide adequate contact force, even when the pin and tab are not perfectly laterally aligned, or if the pin and contact portion are somewhat skewed at an angle. Furthermore, the human factors aspect of loading the terminals into a corresponding housing must be considered such that the terminals are not positioned within their terminal receiving cavities in an improper manner. This would cause an incorrect electrical connection with the pin as well as possible damage to the pin and/or contact portion of the terminal. Lastly, pull-out force of the terminals relative to their housing must be considered, that is, in that a certain pull-out force is required such that if the strain is placed on the wire or cable of the connector, the terminals are not removed from the housing, but yet are locked in place.

For example, U.S. Pat. Nos. 5,266,056 and 5,334,058 show portions of the contact which forms a polarizing feature with the contact housing. They also show a manner of rigidifying the locking lance of the contact.

SUMMARY OF THE INVENTION

The objects of the invention have been accomplished by providing an electrical terminal for contact with a pin, the terminal comprising a contact section and a conductor connecting section. The contact section comprises a base section and upper side wall sections upstanding from the base section. The upper side wall sections comprise front and rear strap portions extending upwardly from the base and a beam section extending between the front and rear strap portions, each the beam being inwardly directed to receive a pin.

In the preferred embodiment of the invention, each inwardly directed section of the beam section includes constricted portions. The inwardly directed section of each beam further comprises at least one inwardly directed projection extending from the constricted portions. Preferably, each beam section includes two inwardly directed projections. The inwardly directed sections are defined by C-shaped deformations in the beam section.

In the preferred embodiment of the invention, the lower side wall sections extend from the base section. The lower side wall sections extend outwardly beyond the upper side wall sections, and a common shear line defines the upper and lower side wall sections.

The inwardly directed section of each the beam further comprises at least one inwardly directed projection extending from the beams.

In yet another embodiment of the invention, an electrical terminal for contact with a pin comprises a contact section and a conductor connecting section. The contact section comprising a base section and side wall sections upstanding from the base section, the side wall sections being separated to define upper side wall sections and lower side wall sections, the upper side wall sections comprising a mating contact for a pin and the lower side wall sections being formed as polarizing extensions, and extending laterally outwardly beyond the upper side wall sections.

In the preferred embodiment of this version, the upper side wall sections comprise front and rear strap portions extending upwardly from the base and a beam section extending between the front and rear strap portions, each beam portion including at least one inwardly directed projection, to form a constricted section for receiving a pin. Each beam section includes two inwardly directed projections, and the inwardly directed sections are defined by C-shaped deformations in the beam section. Preferably, a common shear line defines the upper and lower side wall sections.

In yet another embodiment of the invention, an electrical connector assembly comprises an insulative housing and at least one electrical terminal for contact with a pin. The terminal comprises a contact section having a base section and side wall sections upstanding from the base section. The side wall sections are separated to define upper side wall sections and lower side wall sections, and the lower side wall sections are formed as polarizing extensions, and extend laterally outwardly beyond the upper side wall sections.

The housing includes a terminal receiving cavity for receipt of the terminal, the cavity including a narrow passageway portion for receipt of the upper side wall sections and a wide passageway portion for receipt of the lower side walls sections. The terminal upper side wall sections comprise front and rear strap portions extending upwardly from the base and a beam section extends between the front and rear strap portions, where each the beam portion includes at least one inwardly directed projection, to form a constricted section for receiving a pin.

Preferably, each the beam section includes two inwardly directed projections, where the inwardly directed projections are defined by C-shaped deformations in the beam section. Also preferably, a common shear line defines the upper and lower side wall sections.

DETAILED DESCRIPTION OF THE PREFERRED EMBODIMENT

Figure 2:
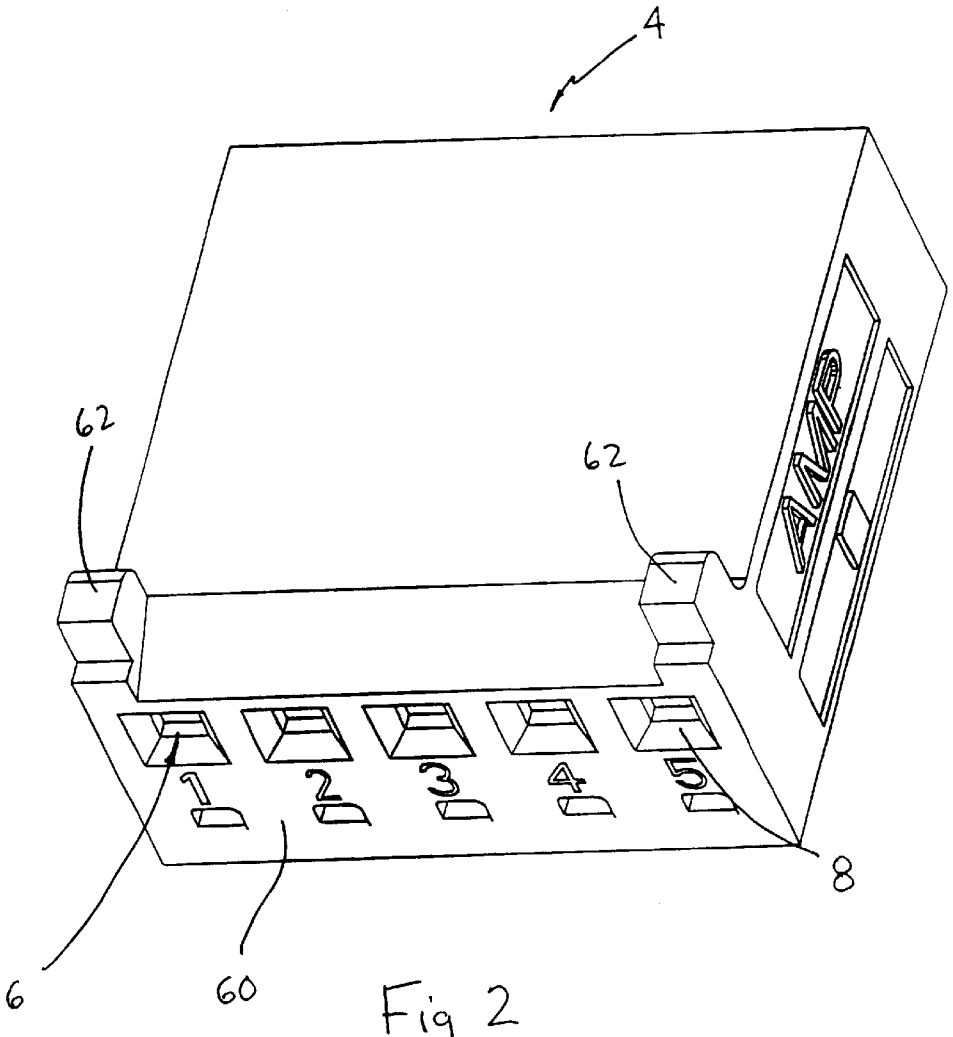
FIG. 2 is a perspective view of the housing of the present invention.
Figure 1:
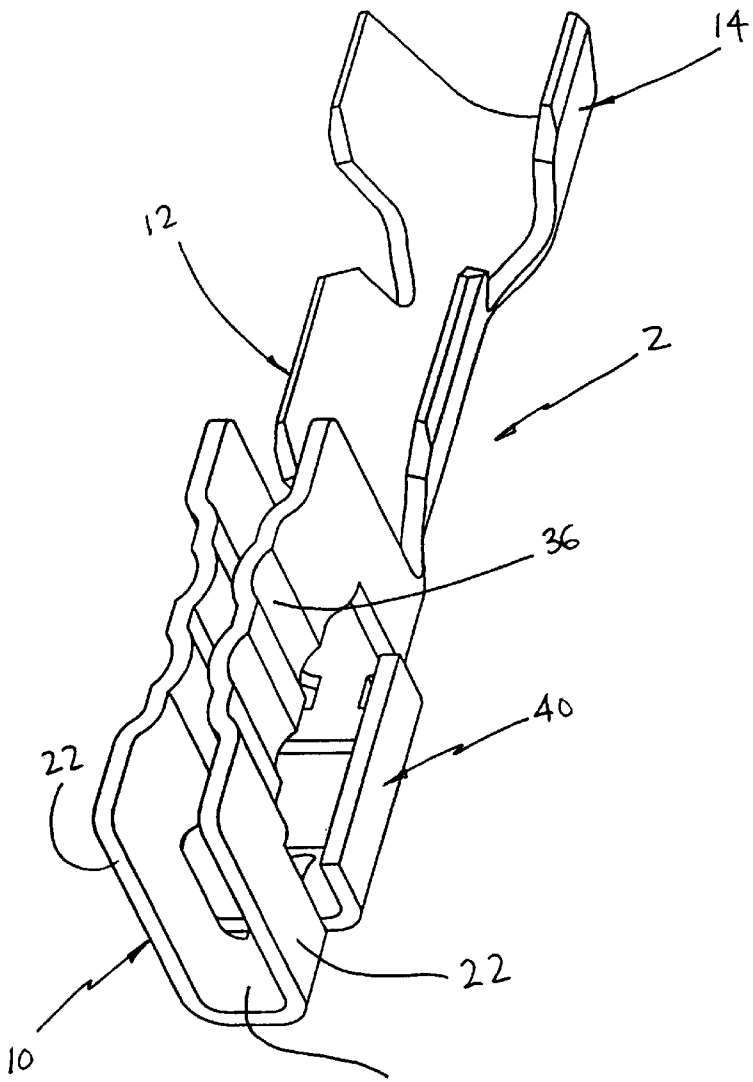
FIG. 1 is a perspective view of the present invention.

With respect first to FIGS. 1 and 2, a contact terminal 2 is shown generally at 2 for receipt within insulative housing 4, as described herein. Housing 4 includes a plurality of terminal receiving cavities 6 and pin receiving openings at 8 for entry of a corresponding pin terminal. With respect again to FIG. 1, contact terminal 2 generally includes a front contact section 10, a crimp section 12, and a strain relief section 14.

Figure 3:
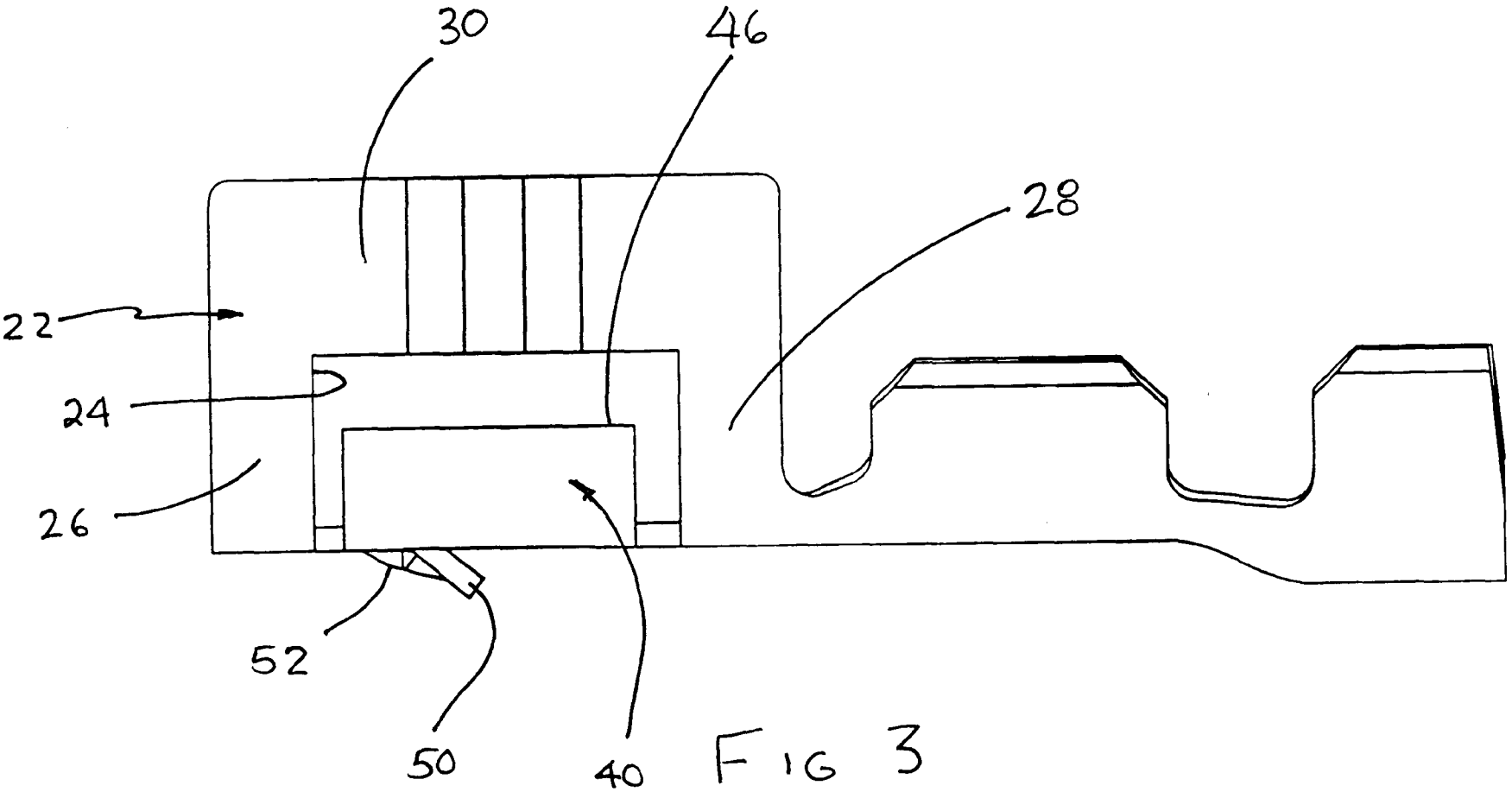
FIG. 3 is a side plan view of the terminal of FIG. 1.
Figure 4:
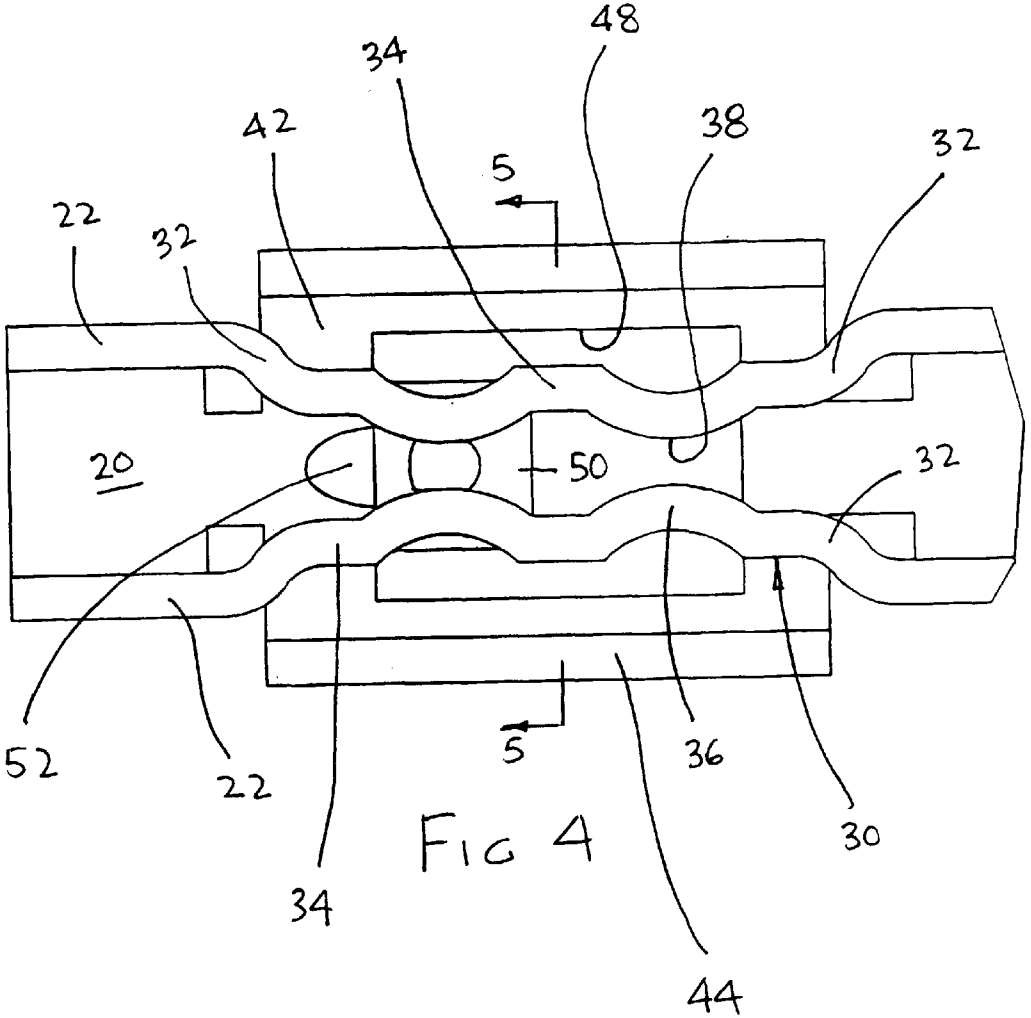
FIG. 4 is a top plan view of the contact portion of the terminal of FIG. 1.

With reference now to FIGS. 1, 3 and 4, the contact terminal will be described in greater detail. As shown best in FIG. 1, the contact section 10 includes a base section 20 with generally upstanding wall sections 22 which upstand from the base section 20 to form parallel and opposed walls. As shown best in FIG. 3, upstanding wall section 22 bounds a stamped opening 24 to define a front strap portion 26 and a rear strap portion 28 extending generally vertically upwardly from base section 20 to intersect with a horizontally extending beam section 30. The beam sections 30 extend in a horizontally and generally opposed relation as described more fully herein to define the contact section.

As shown in FIG. 4, the beam sections 30 are necked down at radiused portions 32 to define constricted wall portions at 34. The constricted wall portions 34 have inwardly directed projections or deformations at 36, which are in a substantial C shape. The inside surface of the inwardly directed projections 36 define inner contact surfaces at 38. As shown best in FIGS. 1 and 4, the C-shaped deformations extend along the entire length of the beam section 30 so as to provide a consistent projection or deformation.

With respect again to FIGS. 1, 3 and 4, a polarizing member is shown at 40. The polarizing member 40 is formed from the blank of metal internal to the stamped opening 24. As shown best in FIG. 4, the polarizing member 40 is formed by a base section 42 which is co-planar with base section 20, with upstanding wall sections 44 which extend outwardly from wall sections 22 but for only a short vertical height. Said differently, as shown in FIGS. 1 and 4, the lateral projection of the contact at the lower portion of the terminal, that is, adjacent to base sections 20 and 42, will be as wide as the upstanding wall portions 44, yet at the top of the terminal the lateral width of the terminal will be that of the parallel walls 22.

Figure 5:
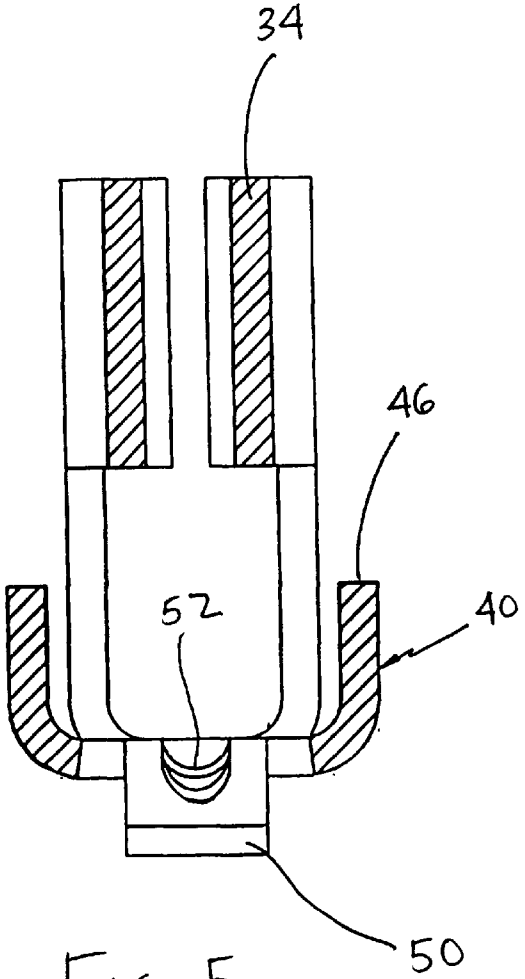
FIG. 5 is a cross sectional view through lines 5—5 of FIG. 4.
Figure 6:
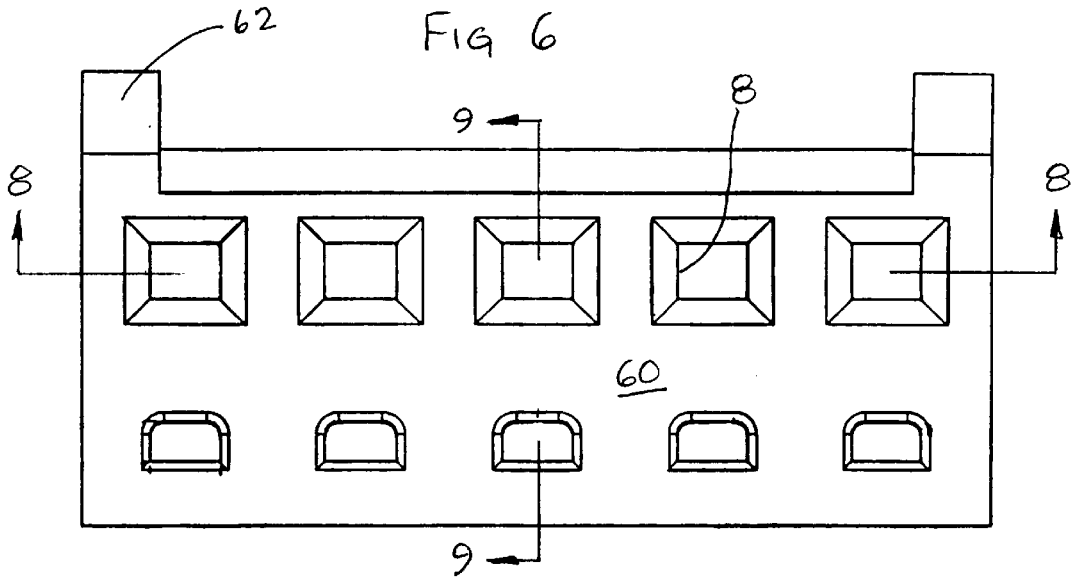
FIG. 6 is a front plan view of the housing of FIG. 2.

Finally, and with respect to FIGS. 4 and 5, the base section 42 includes a stamped out opening at 48 which defines a rearwardly directed locking lance 50 extending downwardly therefrom which includes a swaged section 52 forming a downwardly directed projection shown best in FIG. 3. As shown in FIG. 4, the swaged section 52 is formed at the intersection of the base section 42 and the locking lance 50 so as to reinforce the locking lance and the associated intersection between the base portion 42 and locking lance 50.

Figure 7:
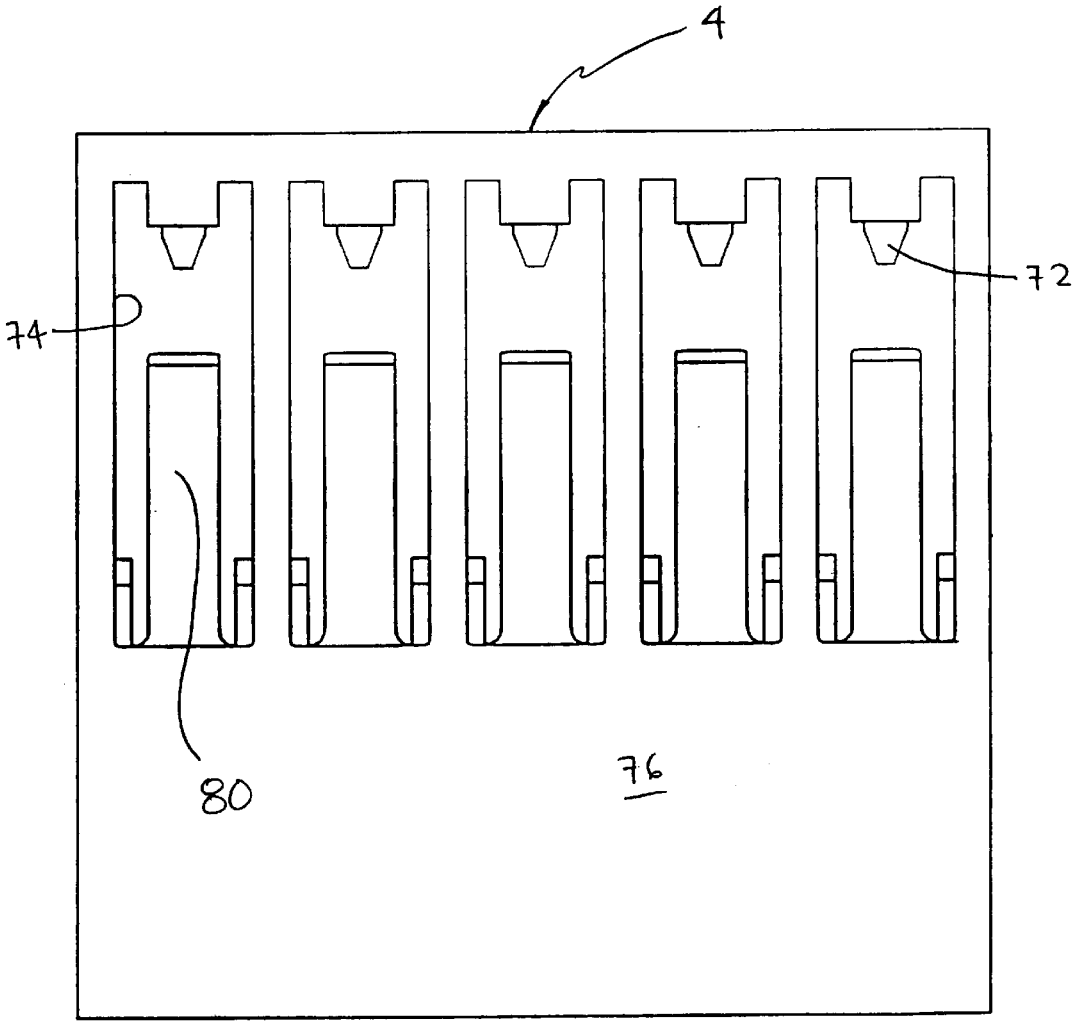
FIG. 7 is a lower plan view of the connector housing of FIG. 6.
Figure 8:
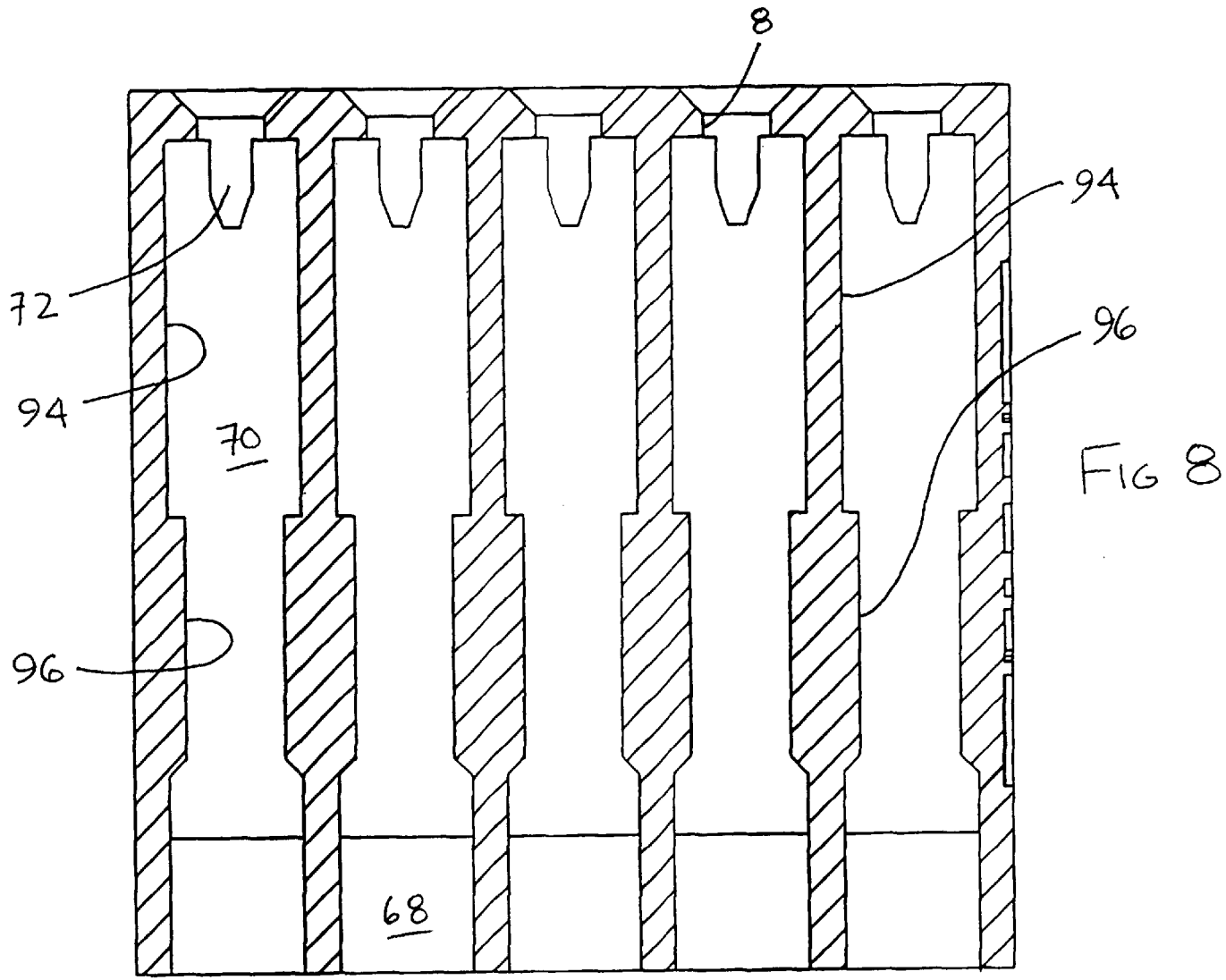
FIG. 8 is a cross sectional view through lines 8—8 of FIG. 6.
Figure 9:
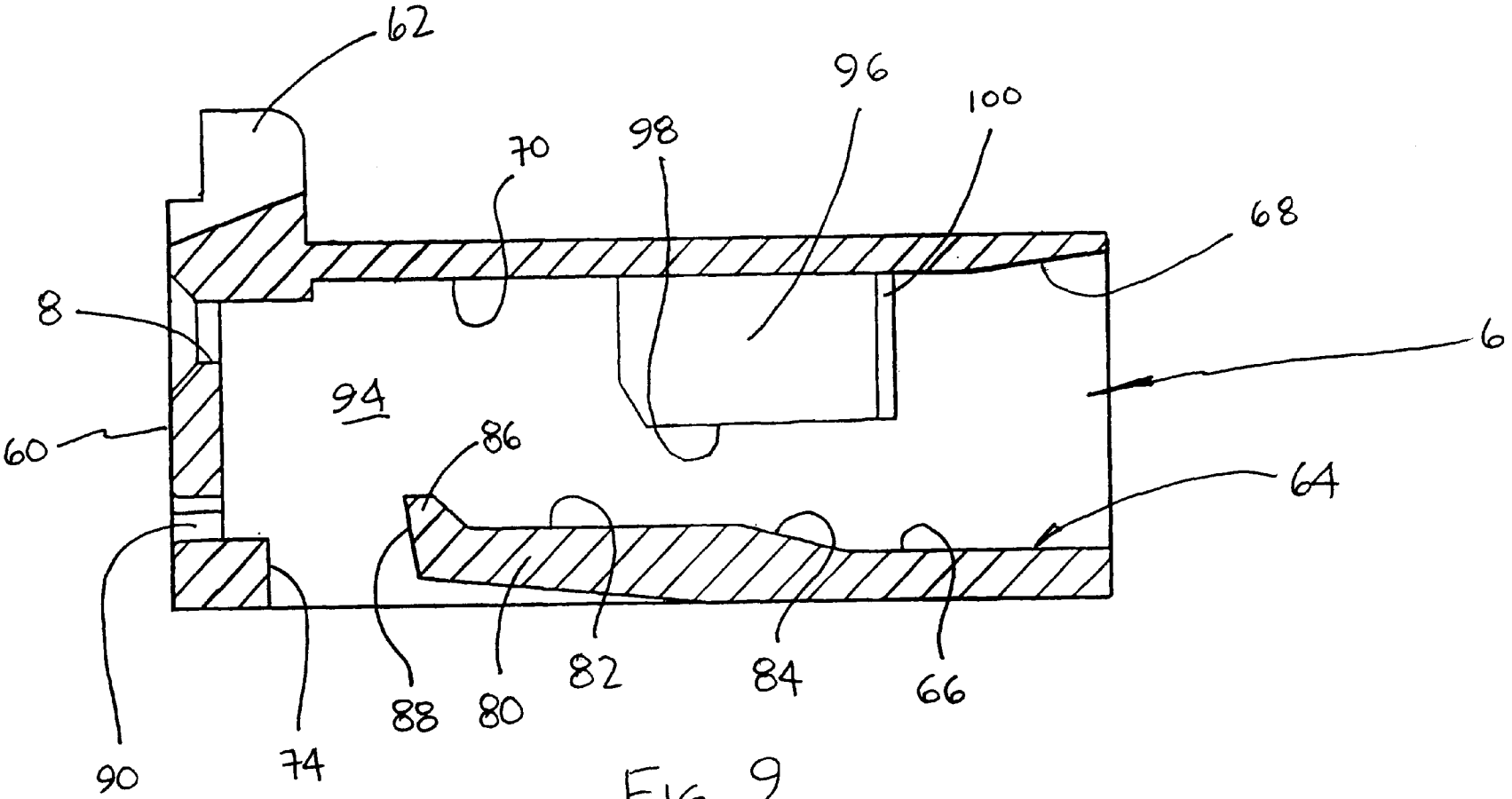
FIG. 9 is a cross sectional view through lines 9—9 of FIG. 6.

With respect now to FIGS. 2, and 6 through 9, the housing 4 will be described in greater detail. With respect first to FIG. 2, the insulative housing 4 generally includes a front mating face 60 flanked by polarizing posts at 62. With reference now to FIGS. 7–9, the internal construction of the terminal receiving cavities 6 is shown in greater detail. As shown best in FIG. 9, the cavities 6 include a rear entry portion 64 which includes a lower surface at 66 and an upper lead-in surface at 68. The cavity 6 further includes an upper surface at 70 which extends forwardly towards the front mating face 60. As shown in FIG. 8, the surface 70 extends forwardly until an anti-stubbing projection at 72.

With reference now to FIG. 7, the housing 4 further includes an opening at 74, through lower face 76, and extending into the cavities 6 with a forwardly projecting cantilevered locking projection 80. As shown in FIG. 9, the locking projection has an upper surface at 82 with a transition surface at 84 transitioning between the lower rear surface 66 and surface 82. The locking lance 80 further includes a locking projection at 86 and a rearwardly angled surface at 88. Openings 90 extend inwardly, through front face 60, and are directed towards the projection 86 as will be described in further detail herein.

Finally, with respect to FIGS. 8 and 9, the terminal receiving cavities 6 are defined by inner side walls 94 having polarizing projections 96 extending outwardly into the cavity as shown best in FIG. 9. The projection 96 includes a lower clearance surface at 98 as well as a chamfered surface at 100.

Figure 10:
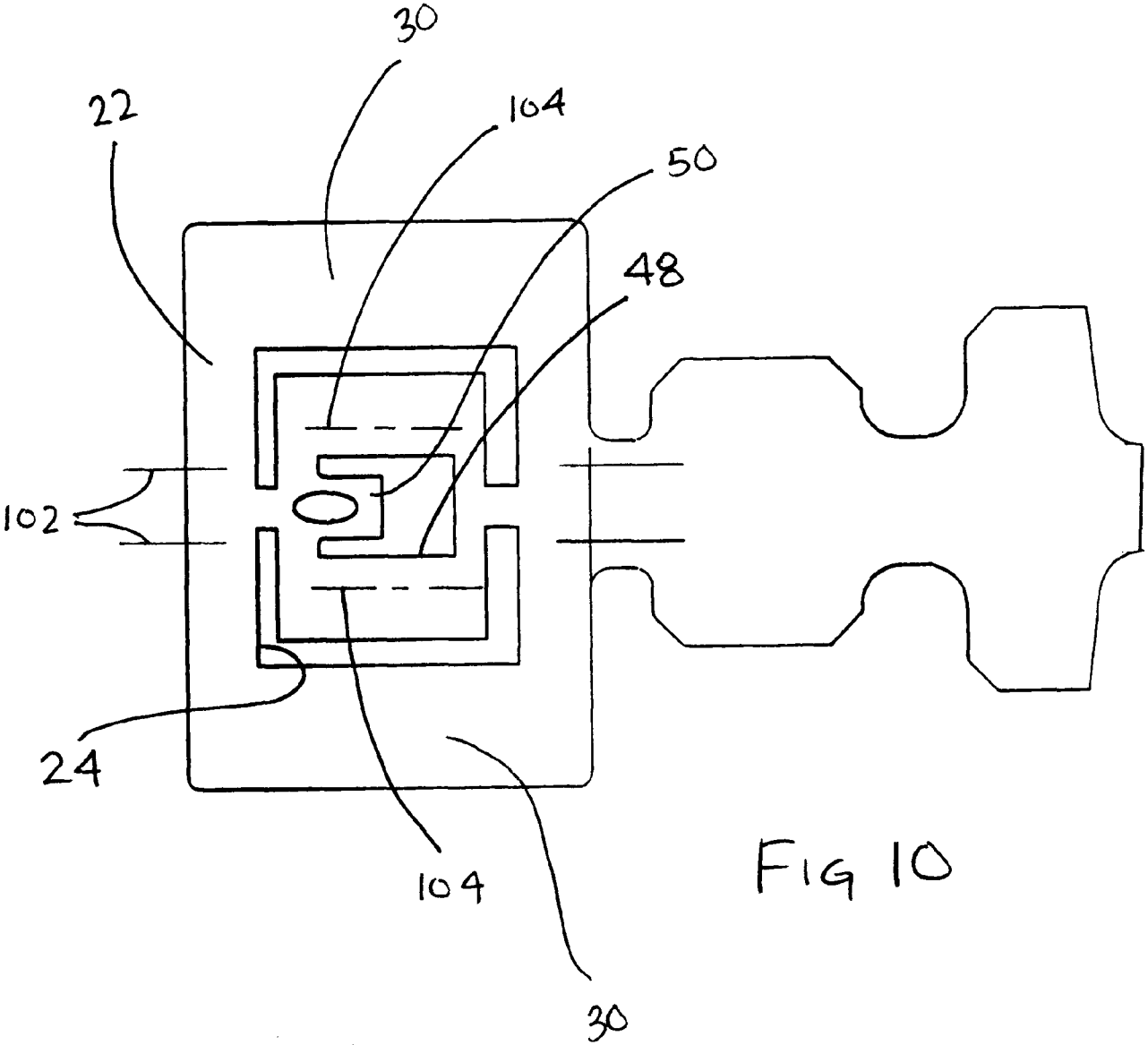
FIG. 10 is a top plan view of the flat blank of the terminal prior to the forming step.

With reference now to FIG. 10, the formation of the contact will be described. Contact terminal 2 is shown in the flat blank state with stamped openings 24 and 48 defining the side walls 22 and locking lance 50. The beam portions 30 will then be formed so as to include both the constricted portions 34 and deformation 36. It should be understood that the side walls 22 will then be formed upwardly about fold lines 102, whereas walls 44 will be folded up about lines 104.

With the contact terminal 2 as described above, the housing 4 can be loaded by placing a plurality of the contact terminals 2 within respective terminal receiving cavities 6 of the housing. This is accomplished by placing the base portion 20 (FIG. 1) on the rear lower surface 66 (FIG. 9) and moving the terminal inwardly towards the front mating face 60. It should be appreciated that the top edge 46 (FIG. 3) of the polarizing member 40 is beneath the clearance surface 98 prior to reaching the transition surface 84. It should also be appreciated that the width of the polarizing walls 40 are such they could not fit between the polarizing projections 96, but rather they are sized to only fit between adjacent side walls 94. It should also be appreciated that the upstanding side walls 22 of the contact terminal fit between the two opposed polarizing projections 96 and allow passage of the contact terminal thereby. The contact terminal can continue forwardly until the locking lance 50 is resiliently biased beyond the locking projection 80 and snaps against angled surface 88.

It should be appreciated that the design of the contact terminal 2 and the corresponding housing 4 accomplish many advantageous features. Firstly, the contact portion 10 is provided with four points of contact, that is, four contact surfaces at 38 (FIG. 4) to provide for redundant contact with a pin terminal. Thus, if a pin is laterally misaligned, or is angularly skewed, the contact between the contact portion and pin will include at least three points of contact. This contact force is also quite resilient, extending from the beam sections 30 and from the constricted portion 34.

This design also provides the advantageous feature that the terminals and cavities are polarized such that polarizing members 40 must be positioned beneath the polarizing projections 96 in order to be properly loaded in the housing. This feature is provided in an efficient use of the stamped material, as described above, in that the same opening 24, which defines the strap portions 26, 28 and beam sections 30, also leaves the remaining metal material which then is formed in the polarizing member 40.

Finally, as the locking lance 50 includes the swaged portion 52, the intersection of the base portion 20 and the looking lance 50 is rigidified by the swaged portion 52, such that the locking lance is strengthened. Moreover, if the contact terminal 2 is strained, the end of the locking lance 50 will move against the surface 88 to enhance the locking force between the contact terminal 2 and housing.

What I claim is:

1. An electrical terminal for contact with a pin, the terminal comprising a contact section and a conductor connecting section, the contact section comprising a base section and upper side wall sections upstanding from said base section, the upper side wall sections comprising front and rear strap portions extending upwardly from said base and a beam section extending between said front and rear strap portions, each said beam being inwardly directed to receive a pin, each said inwardly directed section including constricted portions of said beam section comprising at least two inwardly directed projections extending from said constricted portions, so as to define inner contact surfaces at multiple locations along a length of each beam section.

2. The terminal of claim 1, wherein said inwardly directed projections are defined by C-shaped deformations in said beam section.

3. The terminal of claim 1, further comprising lower side wall sections extending from said base section.

4. The terminal of claim 3, wherein said lower side wall sections extend outwardly beyond said upper side wall sections.

5. The terminal of claim 4, wherein a common shear opening defines said upper and lower side wall sections.

6. The terminal of claim 1, wherein said inwardly directed section of each said beam further comprises at least one inwardly directed projection extending from said beams.

7. An electrical terminal for contact with a pin, the terminal comprising a pin contact section and a conductor connecting section, the pin contact section comprising a base section and side wall sections upstanding from said base section, the side wall sections being separated to define upper side wall sections and lower side wall sections, said upper side wall sections comprising a mating contact for a pin and said lower side wall sections being formed as polarizing extensions, and extending laterally outwardly beyond said upper side wall sections.

8. The terminal of claim 7, wherein said upper side wall sections front and rear strap portions extending upwardly from said base and a beam section extending between said front and rear strap portions, each said beam section including at least one inwardly directed projections, to form a constricted section for receiving a pin.

9. The terminal of claim 8, wherein each said beam section includes two inwardly directed projections.

10. The terminal of claim 9, wherein said inwardly directed sections are defined by C-shaped deformations in said beam section.

11. The terminal of claim 7, wherein a common shear line defines said upper and lower side wall sections.

12. An electrical connector assembly comprising an insulative housing and at least one electrical terminal for contact with a pin, the terminal comprising a pin contact section comprising a base section and side wall sections upstanding from said base section, the side wall sections being separated to define upper side wall sections and lower side wall sections, said lower side wall sections being formed as polarizing extensions, and extending laterally outwardly beyond said upper side wall sections.

13. The assembly of claim 12, wherein said housing includes a terminal receiving cavity for receipt of said terminal, said cavity including a narrow passageway portion for receipt of said upper side wall sections and a wide passageway portion for receipt of said lower side walls sections.

14. The terminal of claim 12, wherein said upper side wall sections comprising front and rear strap portions extending upwardly from said base and a beam section extending between said front and rear strap portions, each said beam section including at least one inwardly directed projection, to form a constricted section for receiving a pin.

15. The terminal of claim 14, wherein each said beam section includes two inwardly directed projections.

16. The assembly of claim 15, wherein said inwardly directed projections are defined by C-shaped deformations in said beam section.

17. The assembly of claim 16, wherein a common shear line defines said upper and lower side wall sections.

* * * * *